US005901553A

United States Patent [19]

Cullen

[11] Patent Number: 5,901,553

[45] Date of Patent: May 11, 1999

[54] METHOD AND SYSTEM FOR ESTIMATING TEMPERATURE OF A HEATED EXHAUST GAS OXYGEN SENSOR IN AN EXHAUST SYSTEM HAVING A VARIABLE LENGTH PIPE

[75] Inventor: Michael John Cullen, Northville, Mich.

[73] Assignee: Ford Global Technologies, Inc., Dearborn, Mich.

[21] Appl. No.: 08/885,206

[22] Filed: Jun. 30, 1997

Related U.S. Application Data

[63] Continuation-in-part of application No. 08/412,663, Mar. 29, 1995, Pat. No. 5,605,040.

[51] Int. Cl.[6] ..... F01N 3/00

[52] U.S. Cl. ..... 60/274; 60/276; 60/287; 123/697

[58] Field of Search ..... 60/274, 276, 287, 60/286; 123/697, 690; 701/109, 103; 73/23.32; 204/421, 427; 364/557

[56] References Cited

U.S. PATENT DOCUMENTS 5,414,994 5/1995 Cullen et al. .
5,497,655 3/1996 Gee et al. .
5,505,183 4/1996 Sinha et al. ..... 123/688
5,669,219 9/1997 Schnaibel et al. ..... 60/274
5,832,721 11/1998 Cullen ..... 60/274

*Primary Examiner*—Christopher Verdier
*Assistant Examiner*—Binh Tran
*Attorney, Agent, or Firm*—Allan J. Lippa; Roger L. May

[57] ABSTRACT

A method for estimating a temperature of a tip of an exhaust gas oxygen (EGO) sensor used with a heater in an electronic engine control for an engine having an exhaust system wherein the exhaust system includes a variable length exhaust pipe having a short path and a long path for transporting exhaust gas from the engine to the HEGO sensor and an exhaust valve positioned in the exhaust pipe for regulating the flow of exhaust gas between the short path and the long path utilizes control logic to determine whether the exhaust gas is flowing through the short path or the long path, determine a temperature of the unheated HEGO sensor based on the path of flow of the exhaust gas, and determine whether the heater is on. If the heater is not on, an amount of heat applied to the sensor is set to zero. If the heater is on, an increase in the temperature of the HEGO sensor is determined based on an amount of heat applied to the sensor. The control logic then determines the temperature of the heated HEGO sensor based on the temperature of the unheated HEGO sensor and the increase in the temperature.

19 Claims, 4 Drawing Sheets

METHOD AND SYSTEM FOR ESTIMATING TEMPERATURE OF A HEATED EXHAUST GAS OXYGEN SENSOR IN AN EXHAUST SYSTEM HAVING A VARIABLE LENGTH PIPE

CROSS-REFERENCE TO RELATED APPLICATION

This application is a continuation-in-part of U.S. patent application Ser. No. 08/412,663, filed Mar. 29, 1995, now U.S. Pat. No. 5,605,040 entitled "Inferring Temperature of a Heated Exhaust Gas Oxygen Sensor".

TECHNICAL FIELD

This invention relates to methods and systems for estimating a temperature of a heated exhaust gas oxygen sensor in an exhaust system having a variable length exhaust pipe.

BACKGROUND ART

It is known to control the air fuel ratio of an internal combustion engine using various air fuel control strategies. Factors such as ambient air pressure, mass air flow, and intake air temperature have been used in the process of controlling air fuel ratio for an internal combustion engine.

Proper operation of a catalyst processing the exhaust gas from an internal combustion engine depends, in part, upon the air fuel ratio supplied to the engine. Associated with the downstream flow of exhaust gas and the catalyst it is known to use an exhaust gas oxygen sensor to sense the concentration of oxygen in the exhaust gas. Knowledge of the exhaust gas oxygen concentration can be used to control the air fuel ratio.

Previous approaches to estimating the temperature of a heated exhaust gas oxygen sensor have failed to take into consideration the effect of a variable length exhaust pipe enabling two paths of exhaust gas flow.

DISCLOSURE OF THE INVENTION

It is thus a general object of the present invention to provide a method and system for estimating the temperature of a heated exhaust gas oxygen sensor in an exhaust system having a variable length exhaust pipe.

In carrying out the above object and other objects, features, and advantages of the present invention a method is provided for estimating the temperature of a heated exhaust gas oxygen (HEGO) sensor in an exhaust system having a variable length exhaust pipe, including a short path and a long path for transporting exhaust gas from the engine to a catalytic converter and further having an exhaust valve positioned in the exhaust pipe for regulating the flow of exhaust gas between the short path and the long path. The method includes the step of determining whether the exhaust gas is flowing through the short path or the long path. The method also includes the step of determining a temperature of the unheated HEGO sensor based on the path of flow of the exhaust gas. Still further, the method includes the steps of determining whether the heater is on, setting an amount of heat applied to the sensor to zero if the heater is not on, and determining an increase in the temperature of the HEGO sensor based on an amount of heat applied to the sensor if the heater is on. Finally, the method includes the step of determining the temperature of the heated HEGO sensor based on the temperature of the unheated HEGO sensor and the increase in the temperature.

In further carrying out the above object and other objects, features, and advantages of the present invention, a system is also provided for carrying out the steps of the above described method. The system includes control logic operative to determine whether the exhaust gas is flowing through the short path or the long path, determine a temperature of the unheated HEGO sensor based on the path of flow of the exhaust gas, determine whether the heater is on, set an amount of heat applied to the sensor to zero if the heater is not on, determine an increase in the temperature of the HEGO sensor based on an amount of heat applied to the sensor if the heater is on, and determine the temperature of the heated HEGO sensor based on the temperature of the unheated HEGO sensor and the increase in the temperature.

An article of manufacture for an exhaust system of an internal combustion engine is also provided for carrying out the above object and other objects, features, and advantages of the present invention. The article of manufacture comprises a computer storage medium having a computer program encoded therein for determining whether the exhaust gas is flowing through the short path or the long path, determining a temperature of the unheated HEGO sensor based on the path of flow of the exhaust gas, determining whether the heater is on, setting an amount of heat applied to the sensor to zero if the heater is not on, determining an increase in the temperature of the HEGO sensor based on an amount of heat applied to the sensor if the heater is on, and determining the temperature of the heated HEGO sensor based on the temperature of the unheated HEGO sensor and the increase in the temperature.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
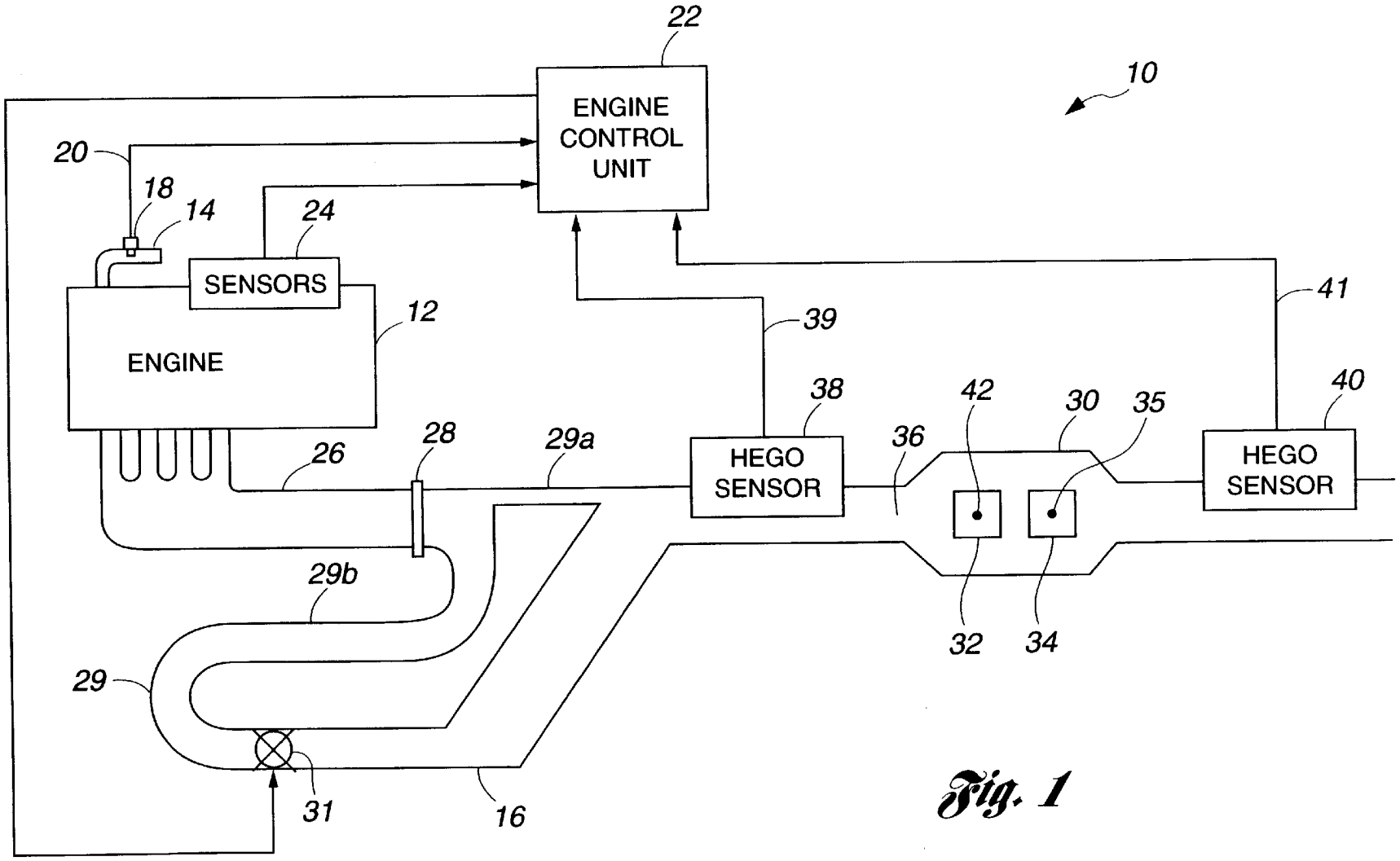
FIG. 1 is a schematic diagram of an engine and control system in accordance with an embodiment of this invention.

Turning now to FIG. 1, there is shown a schematic diagram of the system of the present invention, denoted generally by reference numeral 10. The system 10 includes an internal combustion engine 12 having an intake manifold 14 and an exhaust system 16. Positioned in the intake manifold 14 is a conventional mass air flow sensor 18 for detecting the amount of air inducted into the engine 12 and generating a corresponding air flow signal 20 for receipt by an Engine Control Unit (ECU) 22. The air flow signal 20 is utilized by the ECU 22 to calculate a value termed air mass (AM) which is indicative of a mass of air flowing into the induction system in lbs/min. Alternatively, a conventional manifold absolute pressure sensor (MAPS) may be used to calculate the AM. The air flow signal 20 is also used to calculate a value termed air charge (AIRCHG) which is indicative of air mass per cylinder filling, in units of lbs. per cylinder filling where a cylinder filling occurs once for each cylinder of the engine 12 upon every two engine revolutions for a four-stroke engine. In another embodiment utilizing a two-stroke engine a cylinder filling occurs for each cylinder of the engine 12 upon every engine revolution.

The system 10 further includes other sensors, indicated generally at 24, for providing additional information about engine performance to the ECU 22, such as crankshaft position, angular velocity, throttle position, air temperature, engine coolant temperature, etc. The information from these sensors is used by the ECU 22 to control operation of the engine 12.

Figure 2:
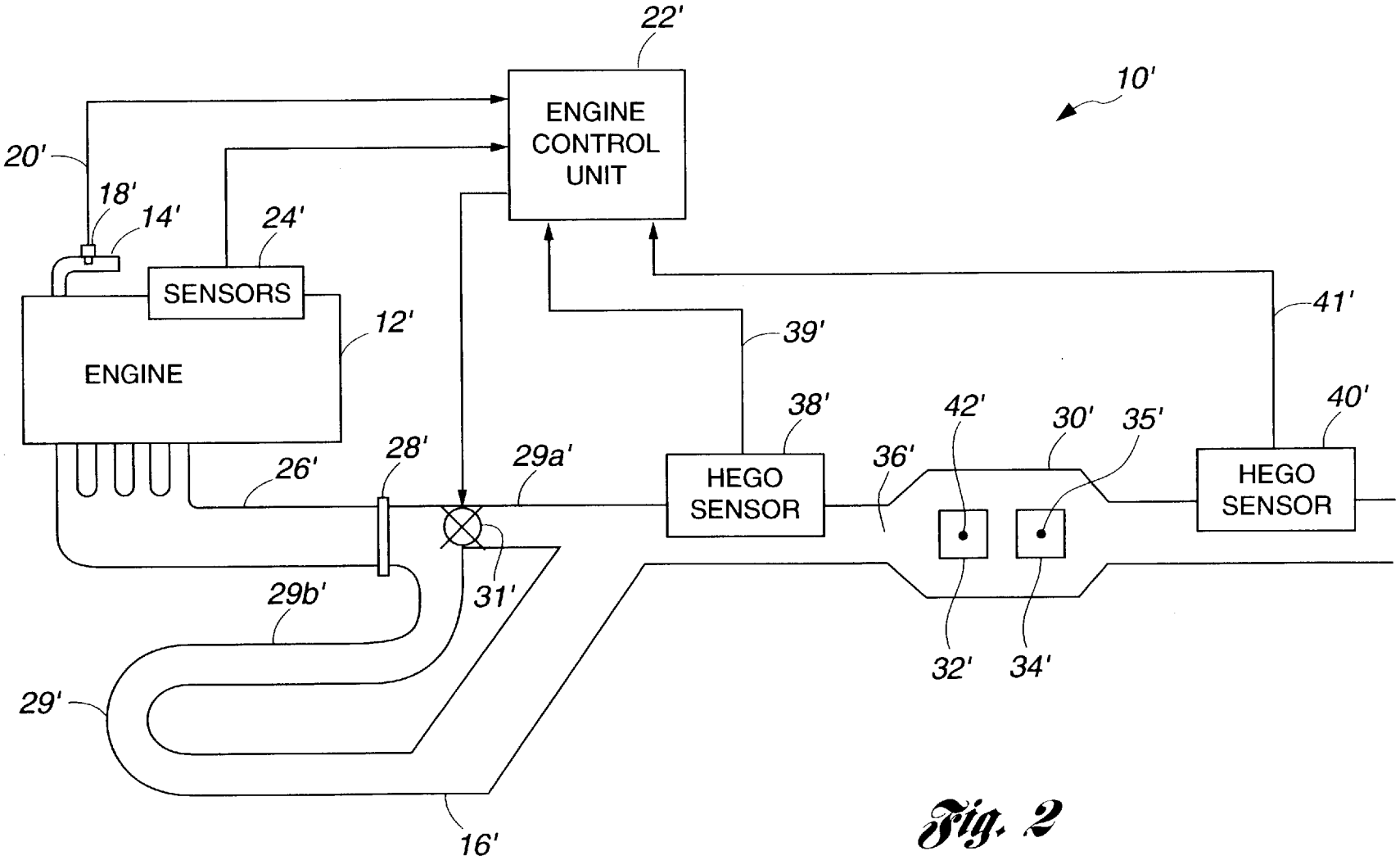
FIG. 2 is a schematic diagram of a second embodiment of the invention shown in FIG. 1.

The exhaust system 16 comprises an exhaust manifold 26, an exhaust flange 28, and a variable length exhaust pipe 29 which provides two paths 29*a*, 29*b* for exhaust gas flow. In the first embodiment, the short path 29*a* is always open. The long path 29*b* includes an Electronic Exhaust Length Control Valve (EELCV) 31 which is controlled by the ECU 22. At high air mass flow, the majority of exhaust gas flows through the path of least resistance, which is the larger diameter long path 29*b*. An alternative embodiment is shown in FIG. 2 in which the EELCV 31' is positioned so that it positively closes the short path 29*a*' when the long path 29*b*' is open. The embodiment shown in FIG. 1 may be preferred since the EELCV 31 is not positioned where it may be subjected to hot temperatures.

The exhaust system 16 transports exhaust gas produced from combustion of an air/fuel mixture in the engine 12 to an integrated three-way catalytic converter/nitrogen oxide ($NO_x$) canister 30. The canister 30 contains a catalyst substrate 32 which receives the exhaust gas produced by the engine 12 via an inlet 36 and then chemically alters the exhaust gas to generate an inert catalyzed exhaust gas. The canister 30 also contains a $NO_x$ trap substrate 34 for trapping $NO_x$ emitted by the engine 12. Alternatively, the $NO_x$ trap may be a separate canister (not shown) from the catalytic canister.

An upstream heated exhaust gas oxygen (HEGO) sensor 38, positioned upstream of the canister 30 on the exhaust system 16 of the engine 12, detects the oxygen content of the exhaust gas generated by the engine 12 and transmits a representative signal 39 to the ECU 22. A downstream HEGO sensor 40, positioned downstream of the canister 30, detects the oxygen content of the catalyzed exhaust gas and transmits a representative signal 41 to the ECU 22. Associated with each sensor 38 and 40 is a resistance heater for providing selective heating of sensors 38 and 40.

Typically, the catalyst 32 of the canister 30 experiences degradation when operated at a temperature greater than approximately 1800 degrees fahrenheit. A temperature at a midbed point, shown at 42, of the catalyst 32 is representative of the temperature of the catalyst 32 in the canister 30. The midbed point 42 is preferably located one inch from the initial point of contact of exhaust gas on the catalyst 32, at the axial centerline of the catalyst 32. Furthermore, a temperature at a midbed point 35 of $NO_x$ trap 34 is representative of the temperature of the $NO_x$ trap 34.

When the engine is started, a timing sensor associated with the ECU 22 indicates the time since the vehicle was last turned off and this value is stored in SOAKTIME, the magnitude representing seconds. The front HEGO sensor tip temperature EXT_FET (Front Ego sensor Tip) is modeled as the sum at the unheated tip temperature EXT_FEU (Front Ego sensor Unheated) and the effect of the electrical resistance heater EXT_FEH (Front Ego sensor Heat).

In initialization, each of these components is assumed to cool off with a first order time constant. The exponential function FNEXP is used to predict the temperature components at any time SOAKTIME after the car was turned off. The temperature components value at car turn off are stored in keep alive memory KAM. INFAMB is the inferred or measured ambient temperature. Analogous logic is used for the rear HEGO sensor tip temperature.

Figure 3:
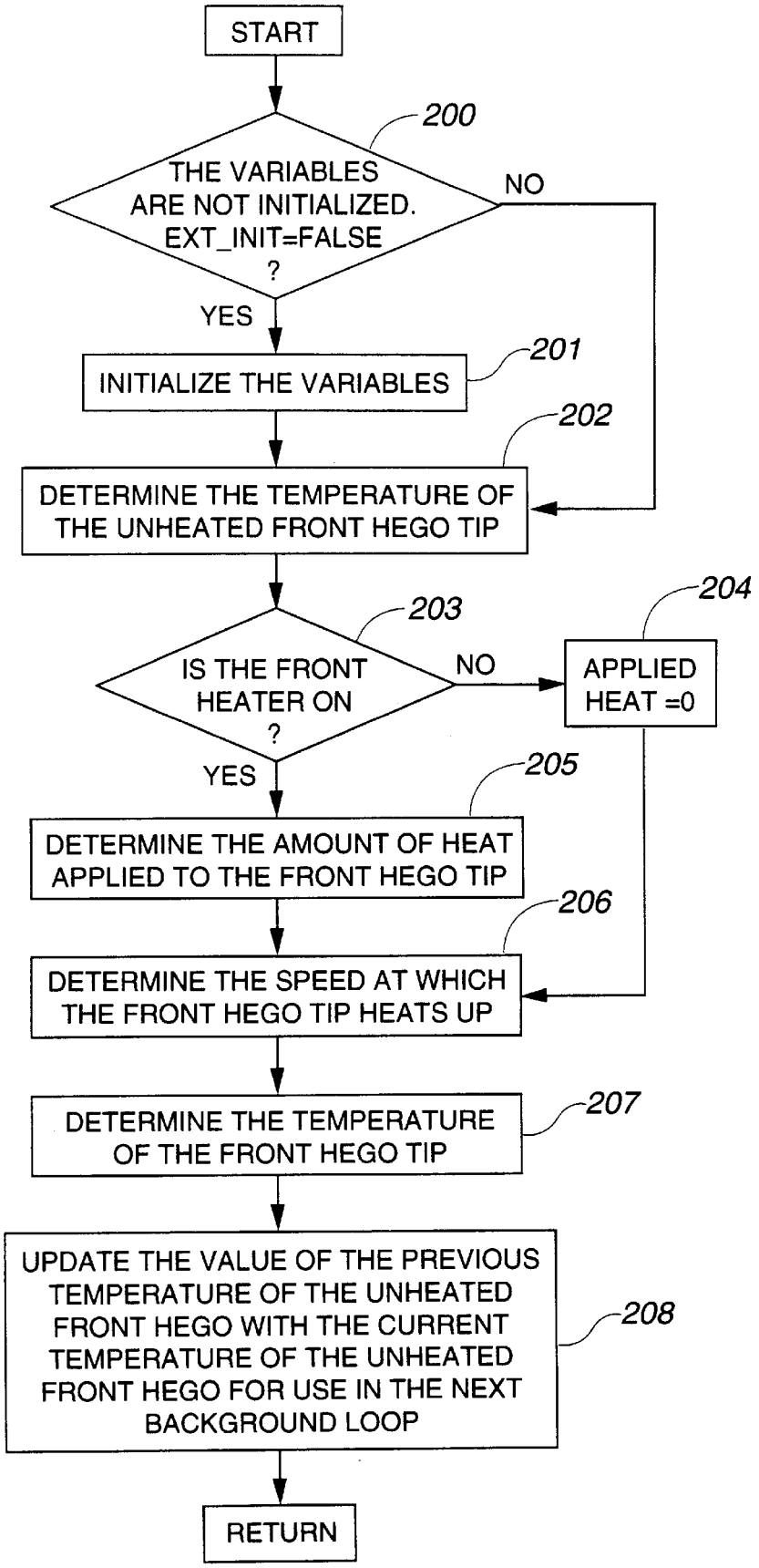
FIG. 3 is a flow diagram in accordance with an embodiment of this invention.

Referring to FIG. 3, the method of estimating the temperature of a heated exhaust gas oxygen sensor is programmed in a routine performed by a control logic, or the ECU 22. The ECU 22 may be comprised of hardware, software, or a combination thereof. Although the steps shown in FIG. 3 are depicted sequentially, they can be implemented utilizing interrupt-driven programming strategies, object-oriented programming, or the like. In a preferred embodiment, the steps shown in FIG. 3 comprise a portion of a larger routine which performs other engine control functions.

The method starts at a decision block 200 wherein it is asked whether a variable has been initialized. EXT_INIT is a boolean variable that is set to FALSE by the ECU 22 only once, during the first background loop of engine strategy operation. If at decision block 200, EXT_INIT does not equal FALSE, the initialization process is skipped and the logic flow continues on to a block 202. If EXT_INIT equals FALSE, logic flow goes on to a block 201 wherein the variables are initialized.

The temperature in degrees of unheated front exhaust gas oxygen sensor 38 (EXT_FEU) is determined by the following formula:

$$\text{INFAMB}+\text{FNEXP}(-\text{SOAKTIME}/\text{TC_SOAK_FEU})*(\text{EXT_FEU_PREV}-\text{INFAMB}) \quad (1)$$

where:

INFAMB is the inferred ambient temperature in degrees,

FNEXP(x) is a lookup table representing the constant e raised to the x,

SOAKTIME is the amount of time in seconds that has elapsed since the engine was last turned off, TC_SOAK_FEU is a calibratable time constant in degrees per second that describes the speed at which unheated front HEGO sensor 38 (EXT_FEU) will cool off after the engine is turned off, and EXT_FEU_PREV is the temperature in degrees of unheated front HEGO sensor 38 from the previous background loop, before the engine was last turned off.

The effect of the heat in degrees that has been applied by the resistance heater to front HEGO sensor 38 (EXT_FEH) is determined by the following formula:

$$\text{FNEXP}(-\text{SOAKTIME}/\text{TC_SOAK_FEH})*(\text{EXT_FEH_PREV}-\text{INFAMB}) \quad (2)$$

where:

TC_SOAK_FEH is a calibratable time constant in degrees per second that describes the speed at which the heat applied to front HEGO sensor 38 will dissipate, and EXT_FEH_PREV is the effect of the heat in degrees that was applied during the previous background loop.

The temperature in degrees of the tip of front HEGO sensor 38 (EXT_FET) is determined by the following formula:

$$\text{EXT_FEU}+\text{EXT_FEH} \quad (3)$$

The last step of initialization is to set the "initialized" flag (EXT_INIT) to TRUE.

Figure 4:
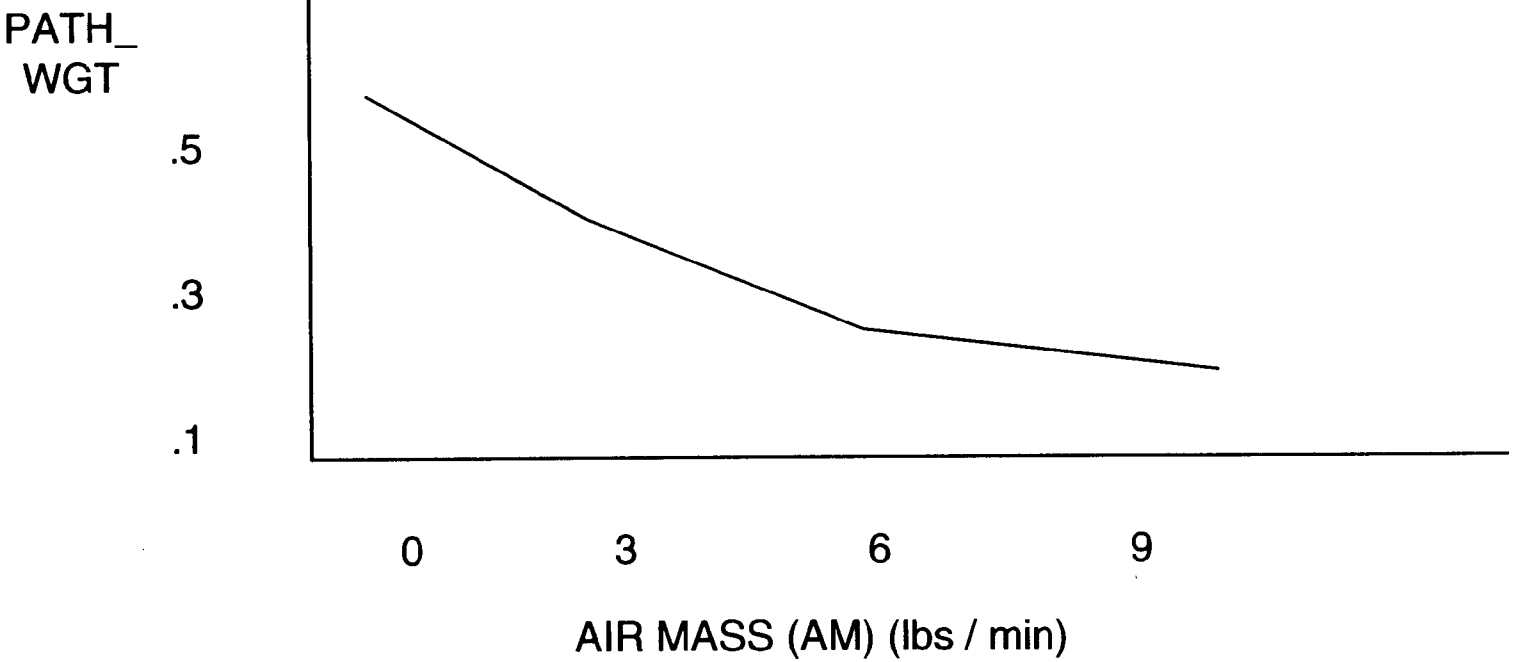
FIG. 4 is a graph illustrating the relationship between the mass of air flow and the flow of exhaust gas.

From block 201 logic goes to block 202 wherein the temperature of unheated front HEGO sensor 38 tip (EXT_FEU) is determined. This is done in five steps. The first step is to determine which path of the exhaust pipe 29 the exhaust gas is flowing. When the short path 29*a* is open, exhaust gas flows through the short path 29*a* entirely. When the long path 29*b* is open, some flow of exhaust gas goes through the long path 29*b* as well as the short path 29*a*. The proportion going through the short 29*a* or long path 29*b* is a function of the air mass flow, AM, and is captured in a calibratable function, FNXX1(AM) as shown in FIG. 4. The status of the EELCV 31 is indicated by a flag EXT_EELCV_FLG where the value 1 indicates the valve 31 is set so the short path 29*a* is being utilized. Thus, if the EXT_EELCV_FLG is set to 1, then all flow is through the short path 29*a*, and a value of 1 is assigned to a variable, path_wgt. If the EXT_EELCV_FLG is not set to 1, the path_wgt corresponds to FNXX1(AM), as discussed above. If the valve 31 is positioned in the exhaust pipe 29 so that it positively closes the short path 29*a* when the long path 29*b* is open, as shown in FIG. 2, then the variable path_wgt is assigned either the value 0 or 1 as described above.

The second step is to calculate the temperature loss from the exhaust flange gas temperature to the front HEGO sensor 38 temperature (EXT_LS_FEU) using the following formula:

$$FN446_TMP*[(EXT_FL+EXT_FEU_PREV)/2-INFAMB] \quad (4)$$

where FN446_TMP is a value indicative of temperature loss as a function of AM and path_wgt. This temperature drop is determined according to the following relationship:

$$FN446_TMP=path_wgt*FN446_short(AM)+(1-path_wgt)*FN446_long(AM), \quad (5)$$

where FN446_short(AM) is a calibratable function representing the temperature drop from the exhaust flange 28 to the front HEGO 38 via the short path 29*a* expressed in units of degrees of actual temperature drop per degrees of potential temperature drop and FN446_long(AM) is a calibratable function representing the temperature drop from the exhaust flange 28 to the front HEGO 38 via the long path 29*b* expressed in units of degrees of actual temperature drop per degrees of potential temperature drop.

The temperature difference is the average of the exhaust flange gas temperature (EXT_FL) and the front HEGO sensor 38 tip temperature from the previous background loop (EXT_FEU_PREV) minus the ambient temperature (INFAMB).

The third step is to calculate the steady state temperature in degrees of unheated front HEGO sensor 38 (EXT_SS_FEU) using the following formula:

$$EXT_FL-EXT_LS_FEU. \quad (6)$$

The fourth step is to calculate the time constant in degrees per second that describes the speed at which the heat from the exhaust of a running engine will change the temperature of the tip of front HEGO sensor 38 (TC_FEU_RUN) by using the function FN443(AM) which determines the time constant for instantaneous front heated exhaust gas oxygen sensor (HEGO) tip temperature versus air mass (AM).

The fifth step to determining the temperature of unheated front HEGO sensor 38 (EXT_FEU) is to determine an instantaneous value of the front HEGO sensor 38, EXT_FEU, which is calculated as a function of the steady state front HEGO temperature EXT_SS_FEU, the time constant of the temperature rise, TC_FEU_RUN and the time required for execution of the background loop, BG_TMR, according to the following relationships:

$$EXT_FEU=(1-FK)*EXT_FEU+FK*EXT_SS_FEU \quad (7)$$

where FK performs an exponential smoothing function according to the following relationship:

$$FK=1/[1+(TC_FEU_RUN/BG_TMR)]. \quad (8)$$

From block 202, logic flow goes to a decision block 203 wherein it is asked if the front heater is on (FRONT_HEATER_ON). If no, logic flow goes to a block 204 which sets the temperature in degrees of applied heat (EXT_SS_FEH) to 0. Then logic flow continues on to block 206.

If, at decision block 203, the front heater is on, logic flow goes to a block 205 which determines the effect of the heat in degrees that has been applied to the tip of front HEGO sensor 38. This is done by using a linear equation versus the HEGO temperature in the following formula:

$$EXT_FEH_INT-EXT_FEH_SLP*EXT_FEU \quad (9)$$

where EXT_FEH_INT is the intercept of the applied heat, EXT_FEH_SLP is the slope of the applied heat and EXT_FEU is the temperature in degrees of unheated front HEGO sensor 38. As an alternate embodiment of the above formula, one could allow for more complex behavior by having a table look up of the effect of the applied heat (EXT_SS_FEH) versus the temperature of unheated front HEGO sensor 38 (EXT_FEU) with piece-wise linear interpolation.

From block 205, logic flow goes to a block 206 wherein the speed in degrees per second at which the tip of front HEGO sensor 38 will heat is determined. This is done by setting a calibratable constant that describes the speed at which front HEGO sensor 38 will heat up (TC_FEH_RUN). As an alternate embodiment, this constant could be a look up table versus air mass (AM). Yet another alternate embodiment would be a look up table versus the temperature of unheated front HEGO sensor 38 (EXT_FEU). Logic flow then goes to a block 207 which determines the current temperature in degrees of the tip of front HEGO sensor 38 (EXT_FET) This is a two-step process.

The first step is to calculate the rolling average of the amount of heat that was applied to front HEGO sensor 38 by the resistance heater (EXT_SS_FEH). The second step finds the current temperature in degrees of the tip of front HEGO sensor 38 (EXT_FET) by adding the temperature in degrees of unheated front HEGO sensor 38 (EXT_FEU) and the temperature in degrees of the effect of the heat applied by the resistance heater (EXT_FEH). From block 207, logic flow continues on to a block 208 which updates the previous value of the temperature in degrees of unheated front HEGO sensor 38 (EXT_FEU_PREV) with the current value of the temperature in degrees of unheated front HEGO sensor 38 (EXT_FEU) for use in the next background loop.

The temperature of unheated rear HEGO sensor 40 tip (EXT_REU) is unaffected by the variable length of the exhaust pipe. Thus, this temperature can be estimated in any conventional manner.

Various modifications and variations will no doubt occur to those skilled in the arts to which this invention pertains. These and all other variations which basically rely on the teachings through which this disclosure has advanced the art are properly considered within the scope of this invention.

What is claimed is:

1. A method for estimating a temperature of a tip of an exhaust gas oxygen sensor used with a heater (HEGO) in an electronic engine control for an engine having an exhaust system, the exhaust system including a variable length exhaust pipe having a short path and a long path for transporting exhaust gas from the engine to the HEGO sensor, the exhaust system further including an exhaust valve positioned in the exhaust pipe for regulating the flow of exhaust gas between the short path and the long path, the method comprising:

determining whether the exhaust gas is flowing through the short path or the long path;

determining a temperature of the unheated HEGO sensor based on the path of flow of the exhaust gas;

determining whether the heater is on;

if no, setting an amount of heat applied to the sensor to zero;

if yes, determining an increase in the temperature of the HEGO sensor based on an amount of heat applied to the sensor; and determining the temperature of the heated HEGO sensor based on the temperature of the unheated HEGO sensor and the increase in the temperature.

2. The method as recited in claim 1 wherein determining the temperature of the unheated HEGO sensor comprises:

determining a temperature loss from a point near an exhaust flange of the exhaust pipe to the HEGO sensor based on the path of flow of the exhaust gas;

determining a steady state temperature of the HEGO sensor based on the temperature loss;

determining a time constant that describes a speed at which the heat from the exhaust of a running engine will dissipate from the tip of the HEGO sensor; and determining a rolling average of the steady state temperature of the unheated HEGO sensor and the effect of the heat of the exhaust of a running engine on the HEGO sensor.

3. The method as recited in claim 2 wherein determining the temperature loss includes determining the temperature loss according to the following:

$$EXT_LS_FEU=fn446_tmp*[((EXT_FL+EXT_FEU_PREV)/2)-INFAMB],$$

where EXT_LS_FEU corresponds to the temperature loss, fn446_tmp is a value indicative of a temperature drop between the exhaust flange and the HEGO sensor as a function of a flow signal, EXT_FL corresponds to the instantaneous temperature of exhaust gas at the exhaust flange, EXT_FEU_PREV corresponds to the previously determined value of an instantaneous temperature of the unheated HEGO sensor, and INFAMB corresponds to a value indicative of an estimate of ambient air temperature in degrees Fahrenheit.

4. The method as recited in claim 3 wherein determining the temperature loss includes determining the value fn446_tmp according to the following:

$$fn446_tmp=path_wgt*fn446_short(AM)+(1-path_wgt)*fn446_long(AM),$$

where path_wgt corresponds to a value representative of the path flow of the exhaust gas, fn446_short(AM) corresponds to a temperature drop from the exhaust flange to the HEGO sensor via the short path expressed in units of degrees of actual temperature drop per degrees of potential temperature drop, and fn446_long(AM) corresponds to the temperature drop from the exhaust flange to the HEGO sensor via the long path expressed in units of degrees of actual temperature drop per degrees of potential temperature drop.

5. The method as recited in claim 1 wherein determining the increase in the temperature of the HEGO sensor includes determining the amount of heat being applied to the tip of the HEGO sensor utilizing a linear equation versus the HEGO sensor temperature in the following formula: EXT_SS_FEH=EXT_FEH_INT−EXT_FEH_SLP*EXT_FEU where EXT_FEH_INT is an intercept of the applied heat versus time, EXT_FEH_SLP is the slope of the applied heat versus time and EXT_FEU is the temperature of the unheated HEGO sensor.

6. The method as recited in claim 1 wherein determining the increase in the temperature of the HEGO sensor includes determining the amount of heat being applied to the tip of the HEGO sensor utilizing a table lookup of the effect of the applied heat versus the temperature of the unheated HEGO sensor with piece-wise linear interpolation.

7. The method as recited in claim 1 wherein determining the temperature of the heated HEGO sensor comprises:

determining a speed at which the HEGO sensor will heat; and determining a rolling average of the magnitude of the amount of heat applied to the HEGO sensor by the heater based on the amount of heat applied to the HEGO sensor and the speed at which the HEGO sensor will heat up.

8. The method as recited in claim 7 wherein determining the speed includes determining the speed utilizing a lookup table versus air mass.

9. The method as recited in claim 7 wherein determining the speed includes determining the speed utilizing a lookup table versus temperature of the unheated HEGO sensor.

10. A system for estimating a temperature of a tip of an exhaust gas oxygen sensor used with a heater (HEGO) in an electronic engine control for an engine having an exhaust system, the exhaust system including a variable length exhaust pipe having a short path and a long path for transporting exhaust gas from the engine to the HEGO sensor, the exhaust system further including an exhaust valve positioned in the exhaust pipe for regulating the flow of exhaust gas between the short path and the long path, the system comprising:

control logic operative to determine whether the exhaust gas is flowing through the short path or the long path, determine a temperature of the unheated HEGO sensor based on the path of flow of the exhaust gas, determine whether the heater is on, set an amount of heat applied to the sensor to zero if the heater is not on, determine an increase in the temperature of the HEGO sensor based on an amount of heat applied to the sensor if the heater is on, and determine the temperature of the heated HEGO sensor based on the temperature of the unheated HEGO sensor and the increase in the temperature.

11. The system as recited in claim 10 wherein the control logic, in determining the temperature of the unheated HEGO sensor, determines a temperature loss from a point near an exhaust flange of the exhaust pipe to the HEGO sensor based on the path of flow of the exhaust gas, determines a steady state temperature of the HEGO sensor based on the temperature loss, determines a time constant that describes a speed at which the heat from the exhaust of a running engine will dissipate from the tip of the HEGO sensor, and determines a rolling average of the steady state temperature of the unheated HEGO sensor and the effect of the heat of the exhaust of the running engine on the HEGO sensor.

12. The system as recited in claim 11 wherein the control logic determines the temperature loss according to the following:

$$EXT_LS_FEU=fn446_tmp*[((EXT_FL+EXT_FEU_PREV)/2)-INFAMB],$$

where EXT_LS_FEU corresponds to the temperature loss, fn446_tmp is a value indicative of a temperature drop between the exhaust flange and the HEGO sensor as a function of a flow signal, EXT_FL corresponds to the instantaneous temperature of exhaust gas at the exhaust flange, EXT_FEU_PREV corresponds to the previously determined value of the instantaneous temperature of the unheated HEGO sensor, and INFAMB corresponds to a value indicative of an estimate of ambient air temperature in degrees Fahrenheit.

13. The system as recited in claim 12 wherein the control logic determines the value fn446_tmp according to the following:

$$fn446_tmp=path_wgt*fn446_short(AM)+(1-path_wgt)*fn446_long(AM),$$

where path_wgt corresponds to a value representative of the path flow of the exhaust gas, fn446_short(AM) corresponds to a temperature drop from the exhaust flange to the HEGO sensor via the short path expressed in units of degrees of actual temperature drop per degrees of potential temperature drop, and fn446_long(AM) corresponds to the temperature drop from the exhaust flange to the HEGO sensor via the long path expressed in units of degrees of actual temperature drop per degrees of potential temperature drop.

14. The system as recited in claim 10 wherein the control logic, in determining the increase in the temperature of the HEGO sensor, determines the amount of heat being applied to the tip of the HEGO sensor utilizing a linear equation versus the HEGO sensor temperature in the following formula: EXT_SS_FEH=EXT_FEH_INT−EXT_FEH_SLP*EXT_FEU where EXT_FEH_INT is an intercept of the applied heat versus time, EXT_FEH_SLP is the slope of the applied heat versus time and EXT_FEU is the temperature of the unheated HEGO sensor.

15. The system as recited in claim 10 wherein the control logic, in determining the increase in the temperature of the HEGO sensor, determines the amount of heat being applied to the tip of the HEGO sensor utilizing a table lookup of the effect of the applied heat versus the temperature of the unheated HEGO sensor with piece-wise linear interpolation.

16. The system as recited in claim 10 wherein the control logic, in determining the temperature of the heated HEGO sensor, determines the speed at which the HEGO sensor will heat, and determines a rolling average of the magnitude of the amount of heat applied to the HEGO sensor by the heater based on the amount of heat applied to the HEGO sensor and a speed at which the HEGO sensor will heat up.

17. The system as recited in claim 16 wherein the control logic, in determining the speed, determines the speed utilizing a lookup table versus air mass.

18. The system as recited in claim 16 wherein the control logic, in determining the speed, determines the speed utilizing a lookup table versus temperature of the unheated HEGO sensor.

19. An article of manufacture for an exhaust system of an internal combustion engine of an automotive vehicle, the exhaust system including a variable length exhaust pipe having a short path and a long path for transporting exhaust gas from the engine to a catalytic converter and an exhaust valve positioned in the exhaust pipe for regulating the flow of exhaust gas between the short path and the long path, the article of manufacture comprising:

a computer storage medium having a computer program encoded therein for determining whether the exhaust gas is flowing through the short path or the long path, determining a temperature of the unheated HEGO sensor based on the path of flow of the exhaust gas, determining whether the heater is on, setting an amount of heat applied to the sensor to zero if the heater is not on, determining an increase in the temperature of the HEGO sensor based on an amount of heat applied to the sensor if the heater is on, and determining the temperature of a heated HEGO sensor based on the temperature of an unheated HEGO sensor and the increase in the temperature.

* * * * *